US007040386B2

(12) United States Patent
Shimoya et al.

(10) Patent No.: US 7,040,386 B2
(45) Date of Patent: May 9, 2006

(54) HEAT EXCHANGER

(75) Inventors: Masahiro Shimoya, Kariya (JP); Eiichi Torigoe, Anjyo (JP)

(73) Assignee: DENSO Corporation, Kariya (JP)

( * ) Notice: Subject to any disclaimer, the term of this patent is extended or adjusted under 35 U.S.C. 154(b) by 337 days.

(21) Appl. No.: 10/649,403

(22) Filed: Aug. 26, 2003

(65) Prior Publication Data

US 2004/0177949 A1 Sep. 16, 2004

(30) Foreign Application Priority Data

Aug. 29, 2002 (JP) ..... 2002-251577
Mar. 4, 2003 (JP) ..... 2003-057361

(51) Int. Cl.
*F28D 1/04* (2006.01)

(52) U.S. Cl. ..... 165/153

(58) Field of Classification Search ..... 165/151–153, 165/DIG. 505

See application file for complete search history.

(56) References Cited

U.S. PATENT DOCUMENTS 1,553,093 A * 9/1925 Modine ..... 165/151
2,252,211 A * 8/1941 Seemiller ..... 165/152
3,515,207 A * 6/1970 Lu ..... 165/151
4,141,411 A * 2/1979 Kalnin et al. ..... 165/151
4,434,846 A * 3/1984 Lu ..... 165/161
4,465,128 A * 8/1984 Krekacs et al. ..... 165/151
4,592,420 A * 6/1986 Hughes ..... 165/151
5,109,919 A * 5/1992 Sakuma et al. ..... 165/151
5,482,115 A * 1/1996 Ikeya et al. ..... 165/151
5,623,989 A * 4/1997 Kroger ..... 165/152
5,667,006 A * 9/1997 Kang et al. ..... 165/151
6,644,389 B1 * 11/2003 Kang et al. ..... 165/146
2004/0149424 A1 * 8/2004 Memory et al. ..... 165/151

FOREIGN PATENT DOCUMENTS

JP 62-284197 * 12/1987 ..... 165/146
JP 2001-50678 2/2001

* cited by examiner

*Primary Examiner*—Teresa J. Walberg
(74) *Attorney, Agent, or Firm*—Harness, Dickey & Pierce, PLC

(57) ABSTRACT

Fins such as corrugated fins or plate fins are formed with meandering projections. A fluid such as air strikes bent parts of the meandering projections or grooves at the back sides while flowing along the fins and becomes turbulent and therefore flows while meandering so as to be directed toward the surfaces of tubes, so flows not only contacting the front and back surfaces of the fins without leaving any dead space, but also striking the surfaces of the tubes. Due to this, no boundary layers are formed at the surfaces of the fins or tubes, so heat conduction is promoted and therefore the heat exchange efficiency between a first fluid such as a refrigerant flowing through the insides of the tubes and a second fluid such as air flowing outside is remarkably improved.

18 Claims, 13 Drawing Sheets

HEAT EXCHANGER

BACKGROUND OF THE INVENTION

1. Field of the Invention

The present invention relates to a heat exchanger such as a condenser, evaporator, or heater core used in an air-conditioning system for automotive or home use.

2. Description of the Related Art

One of the typical configurations of a condenser used for condensing and liquefying a refrigerant compressed by a compressor by air etc. in a conventional air-conditioning system is shown in FIG. 4 and in a partially cutaway enlarged view of FIG. 5. In a condenser 21 of the related art, a plurality of flat tubes 22 formed by extruding an aluminum material are arranged in parallel at predetermined intervals. First and second ends of these tubes are connected to common tubular headers 23 and 24. Corrugated fins 25 comprised of thin sheets of aluminum bent in a wave shape are attached sandwiched between adjoining flat tubes 22. Further, connection blocks 26, 27, etc. for connection of outlets and inlets of the refrigerant at the header 24 to not shown piping are provided. Note that these flat tubes 22 may also be formed with a large number of fine refrigerant passages 28.

While not shown, the header 24 is divided by a partition provided in the middle in the longitudinal direction into upper and lower parts communicating with the connection blocks 26 and 27, respectively. Therefore, the gaseous refrigerant compressed by a not shown compressor flows from the connection block 26 to the header 24, is distributed to the fine refrigerant passages 28 of the group of the over half of the flat tubes at the top among the plurality of flat tubes 22 in the top space from the not shown partition of the header 24, passes through the group of flat tubes 22 at the top, and flows into the other header 23. The refrigerant collected at the header 23 is distributed to the refrigerant passages 28 of the group of flat tubes 22 at the bottom, passes through them, then is collected at the bottom space from the not shown partition of the header 24 and returns from the connection block 27 to a not shown refrigeration cycle. The gaseous refrigerant is cooled by the flow of air through the spaces of the flat tubes 22 and the corrugated fins 25 while flowing through the fine refrigerant passages 28 of the flat tubes 22, so the majority of the refrigerant is condensed and liquefied to form a liquid refrigerant.

Even in a condenser 21 of the related art of this configuration, to promote heat exchange between the corrugated fins 25 and the flow of air, sometimes pieces of the corrugated fins 25 are cut and raised to form a large number of louvers 29 and sometimes the fins are embossed to form relief shapes to obtain so-called "wavy fins" (see Japanese Unexamined Patent Publication (Kokai) No. 2001-50678). The surfaces of the flat tubes, however, are smooth. Further, even at the corrugated fins 25, the parts 30 where the louvers 29 or relief shapes cannot be formed are smooth. Therefore, by just forming louvers 29, relief shapes, etc. at parts of the corrugated fins 25, the heat exchange efficiency between the outer surfaces of the flat tubes 22 and the flow of air at the outside of the tubes 22 is not improved much at all.

SUMMARY OF THE INVENTION

An object of the present invention is to provide a heater exchanger such as a condenser, evaporator, or heater core wherein not only is the heat exchange efficiency improved between fins attached to tubes in which a first fluid such as a refrigerant flows and a second fluid such as air flowing in contact with the same, but also novel means are devised so as to improve the heat exchange efficiency between the outer surfaces of the tubes themselves or the smooth parts of the fins and the second fluid so as to greatly improve the heat exchange efficiency between the first fluid flowing through the inside of the tubes and the second fluid flowing outside of the tubes compared with the past.

According to the present invention, there is provided a heat exchanger provided with a plurality of tubes arranged in parallel with each other and sheet-like fins attached to these so as to bridge the intervals between facing tubes and performing heat exchange between a first fluid flowing through the inside of the tubes and a second fluid flowing in contact with the outer surfaces of the tubes and the fins, characterized in that the originally smooth fins are formed with meandering projections or, when viewed from the rear, meandering grooves. The projections or grooves formed at the fins in this way preferably meander centered about a basic direction of flow of the second fluid so as to be directed toward tubes in which the first fluid flows.

In the heat exchanger of the present invention, since the thus meandering projections and grooves are formed at the fins, while the second fluid is flowing along the fins between the facing tubes, it is disturbed by striking the bent parts of the meandering projections or grooves formed at the fins, so thereafter flows in a turbulent state. Further, the then turbulent flow of the second fluid flows while meandering so as to be directed toward the tubes when viewed from the basic direction of flow, so not only does the turbulent flow contact the front and back surfaces of the fins without leaving any dead spaces, but also flows striking the outer surfaces of the tubes as well. If the turbulent flow of air vigorously contacts the surfaces of the fins or tubes in this way, since no thick boundary layers formed at the surface of the fins or tubes as in the case of a laminar flow will be formed, heat conductance is promoted and therefore the heat exchange efficiency between the refrigerant and air is remarkably improved.

In this case, if the top surfaces of the meandering projections (bottom surfaces of grooves) of the fins are formed with louver-like parts obtained by cutting and raising pieces so as to disturb the flow of the second fluid or are formed with relief shapes, the turbulence of the second fluid will be further strengthened, so a more preferable effect will be obtained. The relief shapes can be made to be aligned with the wave shapes arranged in the longitudinal direction of the tubes centered about the basic direction of flow of the second fluid so as to further enhance the effect.

The fins of the heat exchanger of the present invention may be corrugated fins bent to wave shapes between facing tubes or plate fins connecting a plurality of tubes.

The tubes for the heat exchanger of the present invention may be ones with outer surfaces of flat sectional shapes, wedge shapes, or circular shapes Further, the tubes may be ones forming single fluid passages or ones forming a plurality of fluid passages. When the outer surfaces of the tubes have circular sectional shapes, by arranging the plurality of tubes on the same virtual plane and arranging another plurality of tubes on another virtual plane facing that plane, these pluralities of tubes form large surface areas in the same way as flat tubes, so it is possible to sufficiently receive the second fluid flowing directed by the meandering projections or grooves formed at the fins. Due to this, the heat exchange efficiency between the second fluid and the tubes is improved more.

BRIEF DESCRIPTION OF THE DRAWINGS

These and other objects and features of the present invention will become clearer from the following description of the preferred embodiments given with reference to the attached drawings, wherein.

DESCRIPTION OF THE PREFERRED EMBODIMENTS

Preferred embodiments of the present invention will be described in detail below while referring to the attached figures.

Figure 1:
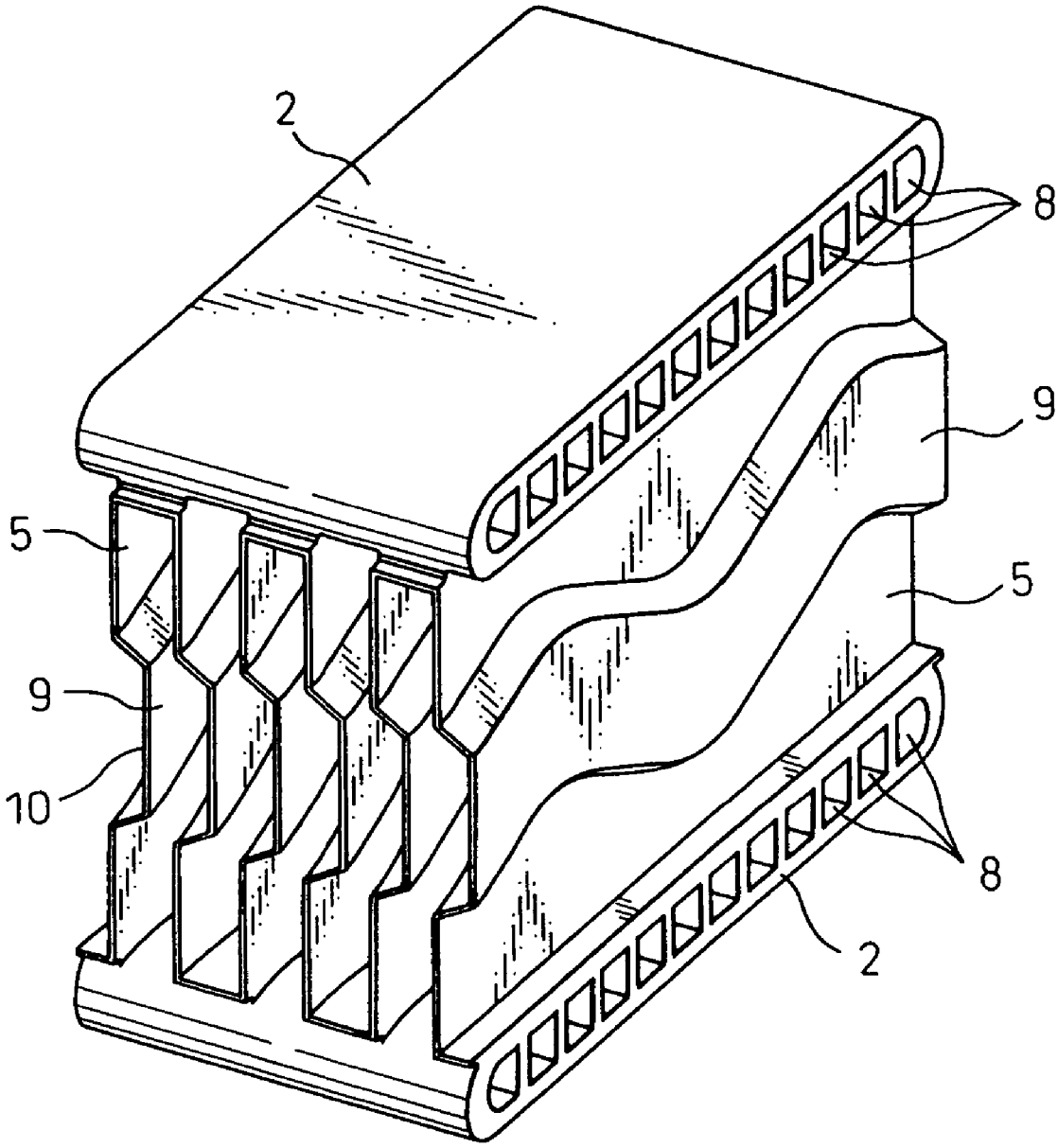
FIG. 1 is a cutaway, enlarged perspective view of principal parts of a condenser of a first embodiment of the present invention.
Figure 2:
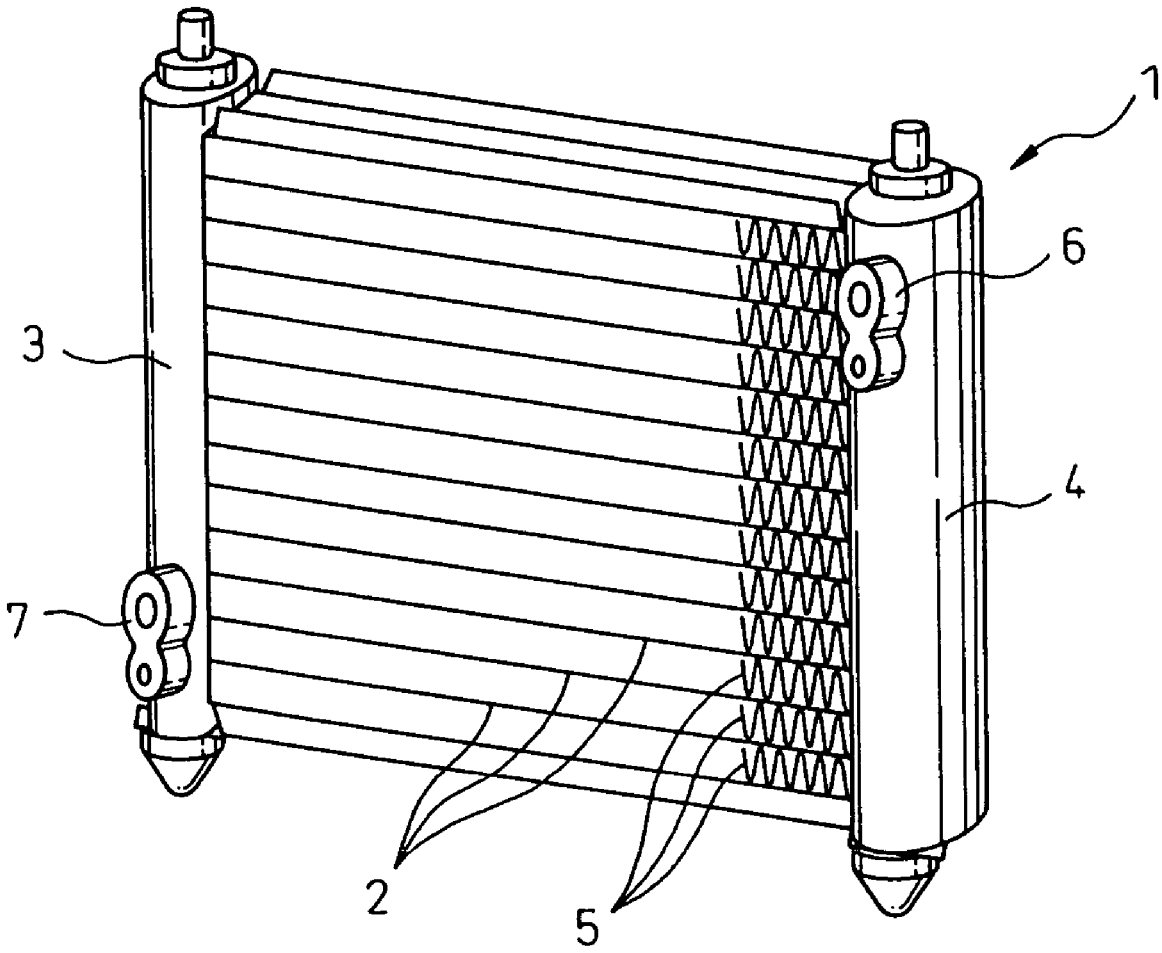
FIG. 2 is a perspective view illustrating the overall configuration of a condenser of an embodiment of the present invention as represented by the first embodiment.
Figure 3:
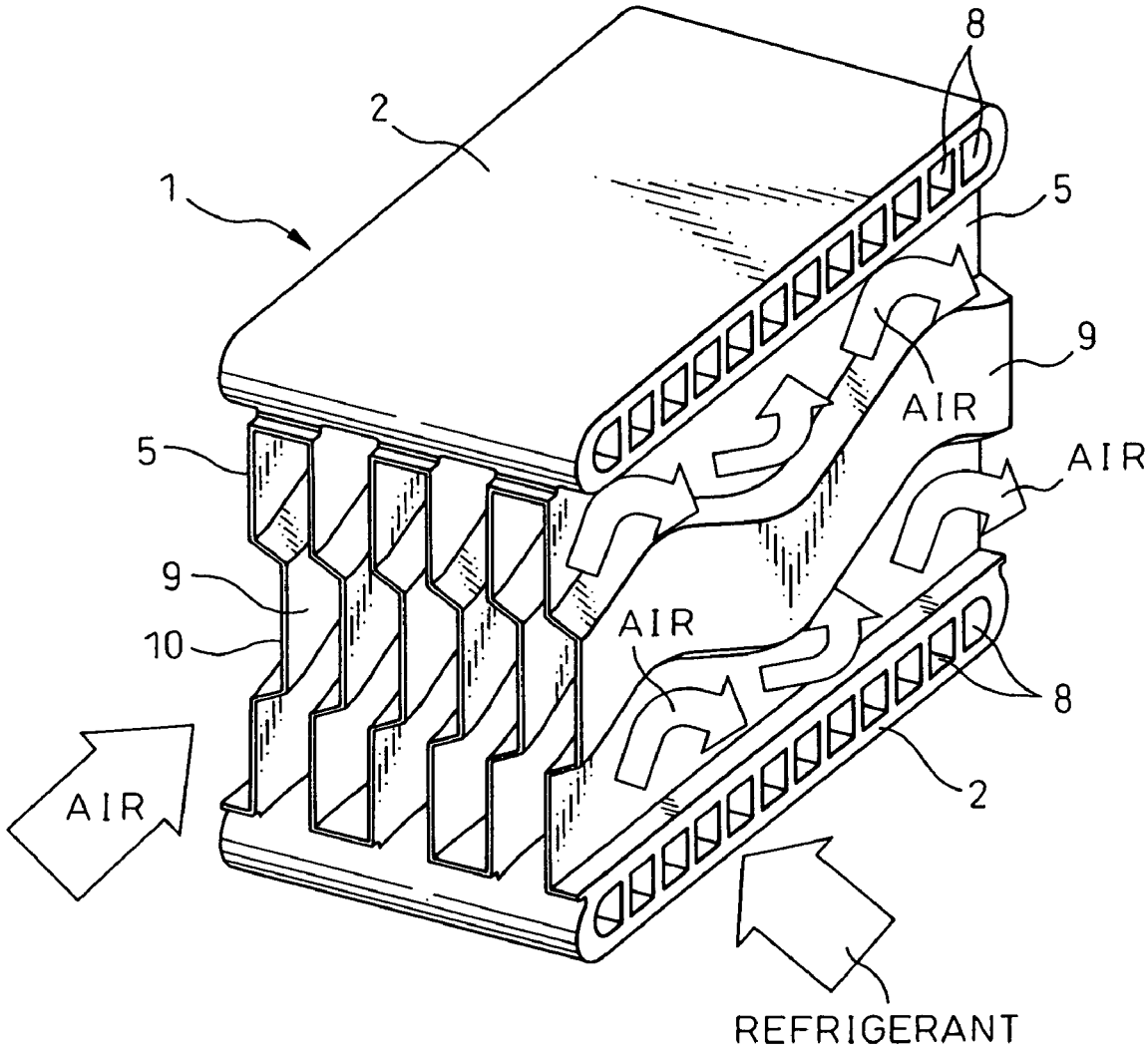
FIG. 3 is a perspective view of the state of operation at principal parts of the condenser of the first embodiment.

The configuration and operation of a condenser 1 for an air-conditioning system are illustrated in FIG. 1 to FIG. 3 as a first embodiment of a heat exchanger of the present invention. FIG. 1 shows enlarged the characterizing parts (principal parts) of the first embodiment, the overall configuration including these parts is illustrated in FIG. 2, and the state of operation of the principal parts is shown in FIG. 3.

Figure 4:
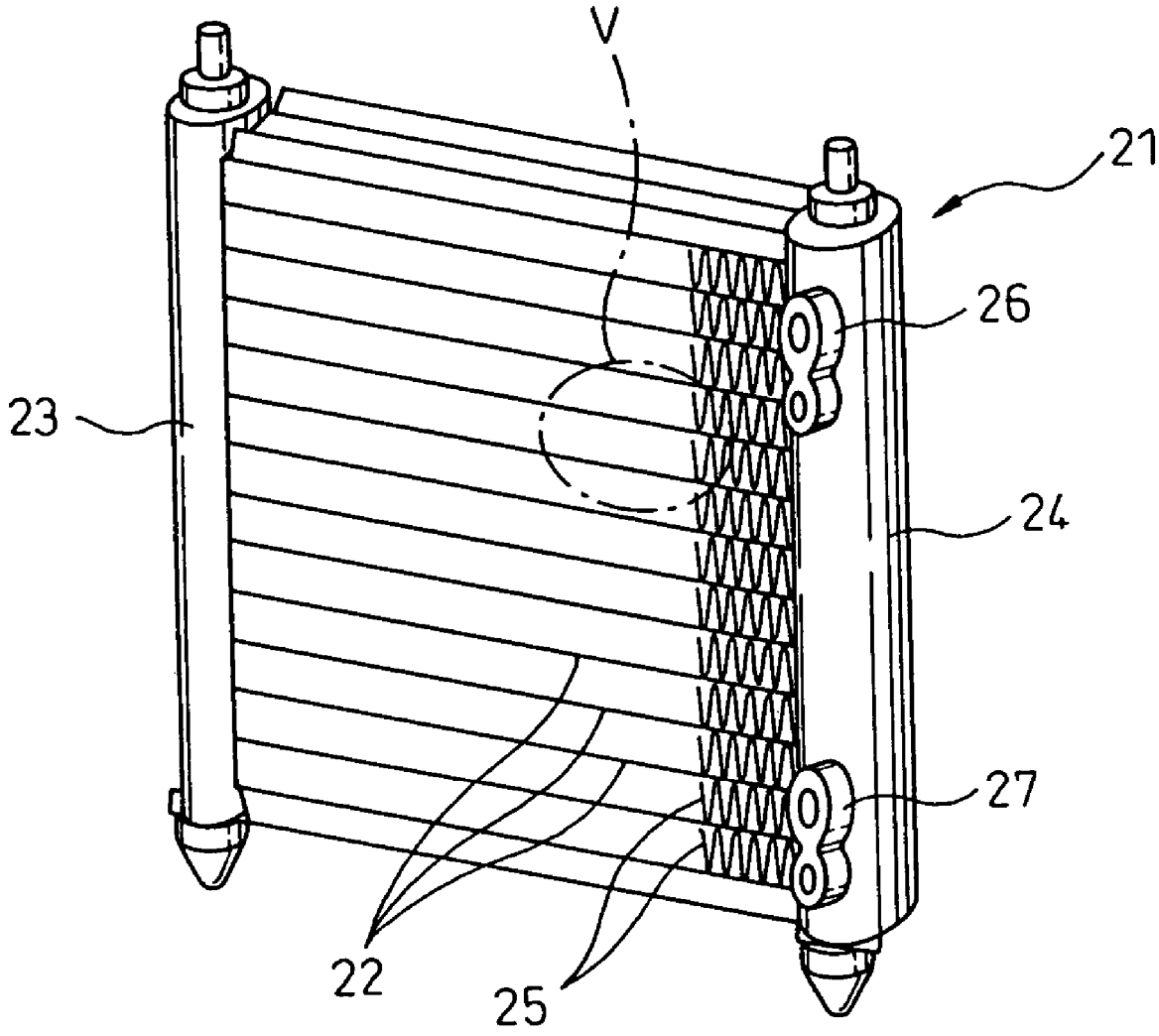
Fig. 4 PRIOR ART
FIG. 4 is a perspective view illustrating the overall configuration of a condenser of the related art.

As shown in FIG. 2, in the condenser 1 of the first embodiment, in the same way as the related art shown in FIG. 4, a plurality of flat tubes 2 formed by extruding an aluminum material are arranged in parallel at predetermined intervals. First and second ends of these tubes 2 are connected to common tubular headers 3 and 4. Corrugated fins 5 formed by bending thin sheets of aluminum into wave shapes are attached sandwiched between adjoining facing flat tubes 2. Further, a connection block 6 for connection of an inlet of the refrigerant at the header 4 to not shown piping is provided, while a connection block 6 for connection of an outlet of the refrigerant of the other header 3 to again not shown piping is provided. As shown in FIG. 1, all of these flat tubes 2 are formed with a large number of fine refrigerant passages 8.

Note that in the same way as in the case of the related art, the flat tubes 2, headers 3 and 4, corrugated fins 5, connection blocks 6 and 7, etc. are all soldered together. For this purpose, the materials of these parts are coated with solder in advance, the parts are assembled, then the assembly is heated in a furnace to melt the solder. When this solidifies, the parts are integrally joined.

While not shown, it is also possible to provide partitions in the middle of the longitudinal direction of one or both of the headers 3 and 4 to divide the inside of the header or headers into a plurality of sections. Due to this, the refrigerant will flow back and forth between the headers 3 and 4. The manner of flow of the refrigerant changes depending on the number of partitions and the locations where they are provided, so which of the headers 3 and 4 to provide the connection blocks 6 and 7 at is determined in accordance with this. Therefore, in the present invention, it is also possible that the connection blocks 6 and 7 be provided at positions like the connection blocks 26 and 27 in the condenser 21 of the related art shown in FIG. 4.

When the condenser 1 of the first embodiment is not provided with partitions in the headers 3 and 4, the gaseous refrigerant compressed by a not shown compressor flows from the connection block 6 to the inside of the header 4, is distributed to the fine refrigerant passages 8 formed at all of the flat tubes 2, passes through these flat tubes 2, and flow into the other header 3. The refrigerant collected at the header 3 returns from the connection block 7 to a not shown refrigeration cycle. The gaseous refrigerant supplied to the header 4 in this way is cooled by the flow of air through the spaces of the flat tubes 2 and corrugated fins 5 while flowing through the fine refrigerant passages 8 of the flat tubes 2, so almost all of the refrigerant is condensed to a liquid state. In the present invention, the fluid such as the refrigerant flowing through the insides of the tubes such as the flat tubes 2 is called the "first fluid" and the fluid such as air flowing outside of the tubes is called the "second fluid".

Corresponding to the characteristics of the present invention, in the condenser 1 of the first embodiment, parts of the corrugated fins 5 are formed with meandering projections 9 by a method such as press forming. If viewing these meandering projections 9 from the rear of the corrugated fins 5, they form meandering grooves 10. The meandering projections 9 (or meandering grooves 10) are oriented so as to be directed to above and below the basic direction of flow of the air of the second fluid, that is, so as to head toward the surfaces of the flat tubes 2. These meandering projections 9 can also be formed simultaneously when forming the corrugated fins 5 by press forming, but it is easy to form meandering projections at the aluminum sheet material in advance, then bend the sheet material to form the corrugated fins 5. The press forming machine and shaping die also become simpler.

Figure 5:
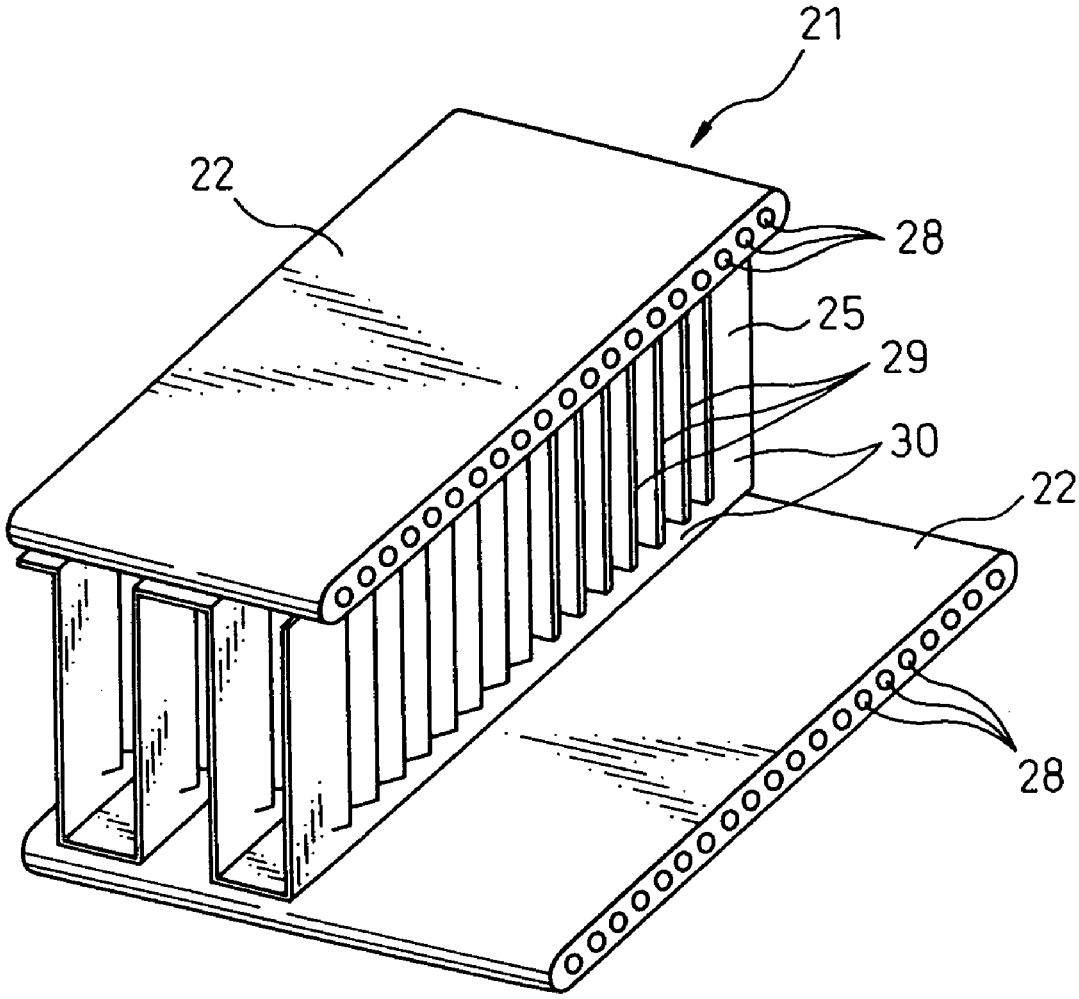
Fig.5 PRIOR ART
FIG. 5 is a cutaway, enlarged perspective view of principal parts of a condenser of the related art.

Since the condenser 1 of the first embodiment is configured in this way, the refrigerant (first fluid) passing through the connection block 6 shown in FIG. 2 and flowing into the space inside the header 4 is branched and flows into the large number of fine refrigerant passages 8 of the plurality of flat tubes 2. The heat of the compressed refrigerant is conducted from the surfaces of the flat tubes 2 and the surfaces of the corrugated fins 5 attached to parts of the same to the air (second fluid) flowing in contact with those surfaces, whereby heat is exchanged. The refrigerant lowered in temperature, condensed, and liquefied due to this is collected at the other header 3, passes through the connection block 7, and returns to the not shown refrigeration cycle. In this case, if the corrugated fins 5 are smooth along the direction of flow of the air or if louvers 29 are provided by cutting and raising pieces of the material as in the related art shown in FIG. 5, the air will not strongly contact the surfaces of the flat tubes 2 or the corrugated fins 5, so a sufficiently high heat exchange efficiency will not be obtained as explained above.

As opposed to this, in the condenser 1 of the first embodiment, since the meandering projections 9 or grooves 10 are formed at the smooth surfaces of the corrugated fins 5, when air flows along the corrugated fins 5 among the plurality of flat tubes 2, as shown in FIG. 3, the flow of air will strike the bent parts of the meandering projections 9 or grooves 10 and be disturbed, whereafter it will become turbulent in state. Therefore, in the case of the first embodiment, the now turbulent flow of air flows while meandering repeatedly directed toward the upward and downward directions when seen from the basic direction of flow, so not only will contact the front and back surfaces of the corrugated fins 5 without leaving any dead space, but will also strike the smooth surfaces of the flat tubes 2. If turbulent air contacts the surfaces of the corrugated fins 5 or flat tubes 2, since no thick boundary layers formed at the surfaces as in the case of a laminar flow will be formed, heat conductance is promoted and therefore the heat exchange efficiency between the refrigerant and air is remarkably improved.

Figure 6:
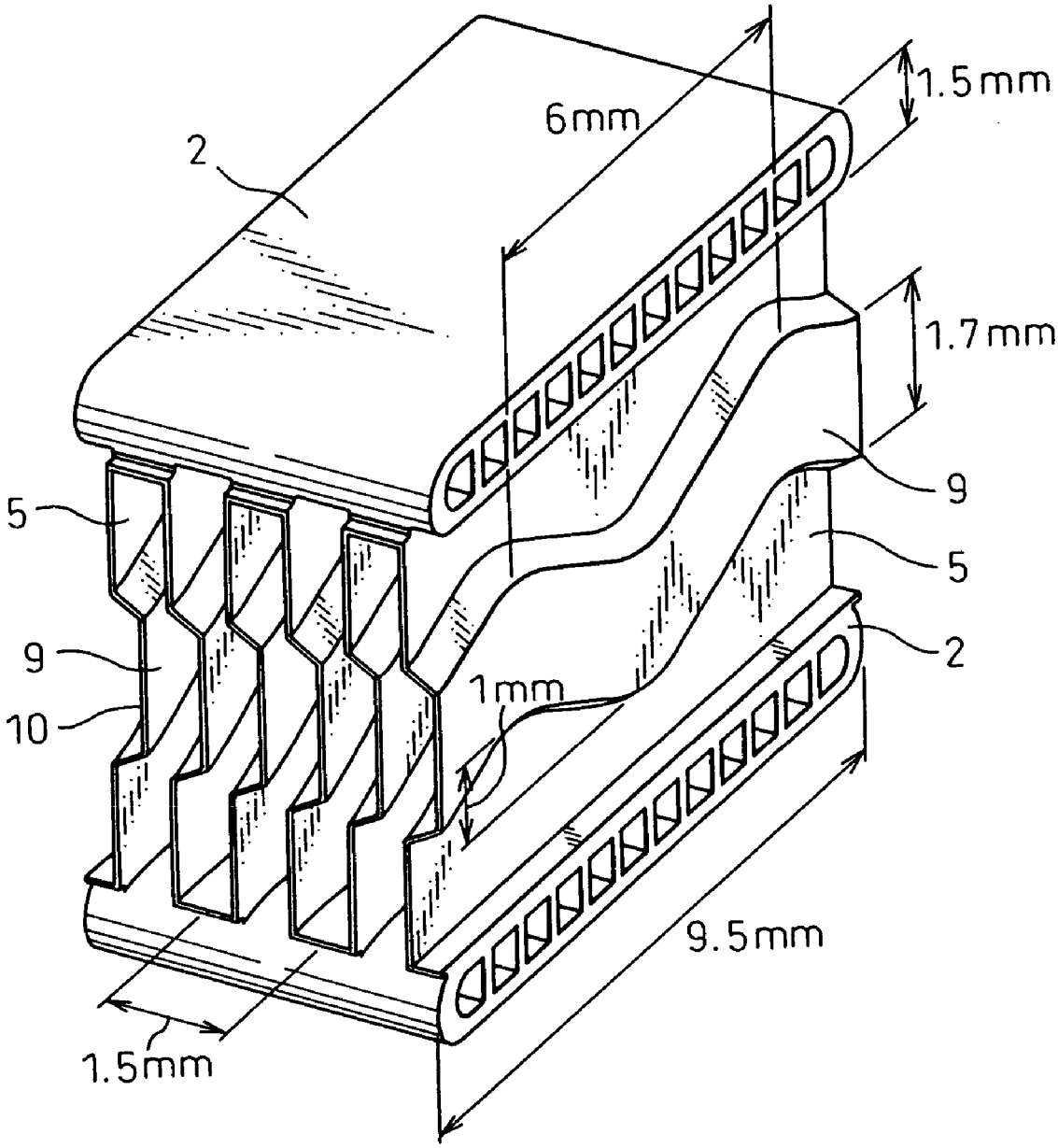
FIG. 6 is a perspective view illustrating specific dimensions of principal parts of a condenser of a first embodiment.

The specific dimensions of the principal parts of the condenser 1 of the first embodiment shown in FIG. 1 are illustrated in FIG. 6. In the case of a condenser for an air-conditioning system for an automobile or the home, the dimensions of the parts become values smaller than those illustrated.

Figure 7:
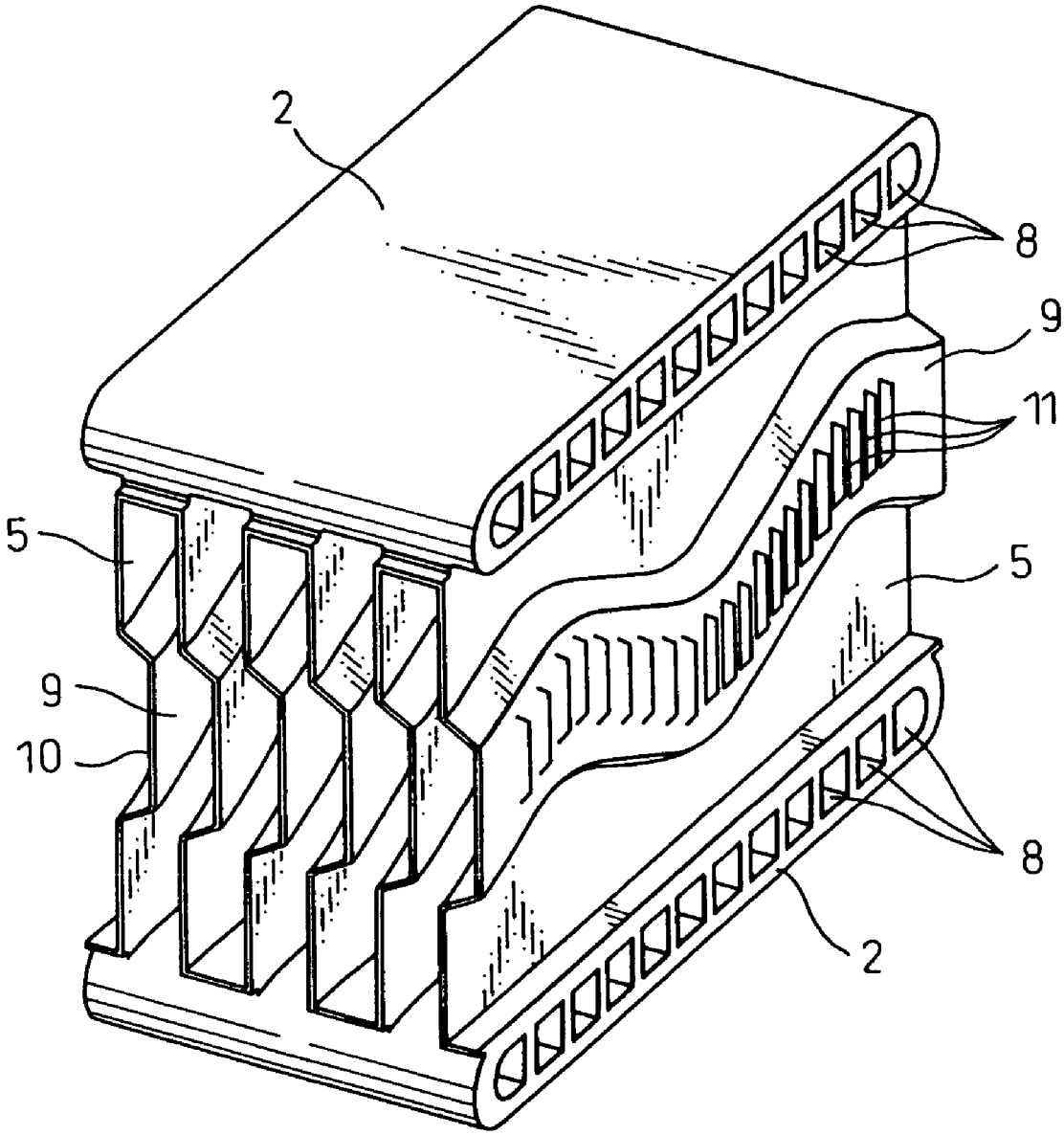
FIG. 7 is a perspective view illustrating specific dimensions of principal parts of a condenser of a second embodiment.

FIG. 7 shows enlarged the principal parts of a condenser according to a second embodiment of a heat exchanger of the present invention. The overall configuration of the condenser of the second embodiment is not illustrated, but generally results in an appearance similar to the condenser 1 of the first embodiment shown in FIG. 2 or the capacitor 21 of the related art shown in FIG. 4. In the embodiments from the second embodiment on, parts substantially the same as those of the first embodiment are assigned the same reference numerals and therefore overlapping explanations are omitted. As clear from a comparison of FIG. 7 with FIG. 1 showing principal parts of the first embodiment, the second embodiment is characterized in the point of formation of a large number of louvers 11 by cutting and raising pieces of the smooth top surfaces of the meandering projections 9. The density of the louvers 11, the heights cut and raised, the angle of inclination of the louvers 11, etc. may be partially changed.

In the second embodiment, since the louvers 11 are provided in addition to the configuration of the first embodiment, the flow of air between the flat tubes 2 is not only disturbed by the meandering projections 9 and grooves 10 to give turbulence, but are also disturbed by the louvers 11 and vigorously strikes the corrugated fins 5 as a whole and the smooth surfaces of the flat tubes 2, so the heat exchange efficiency between the refrigerant and the air is further enhanced.

Figure 8:
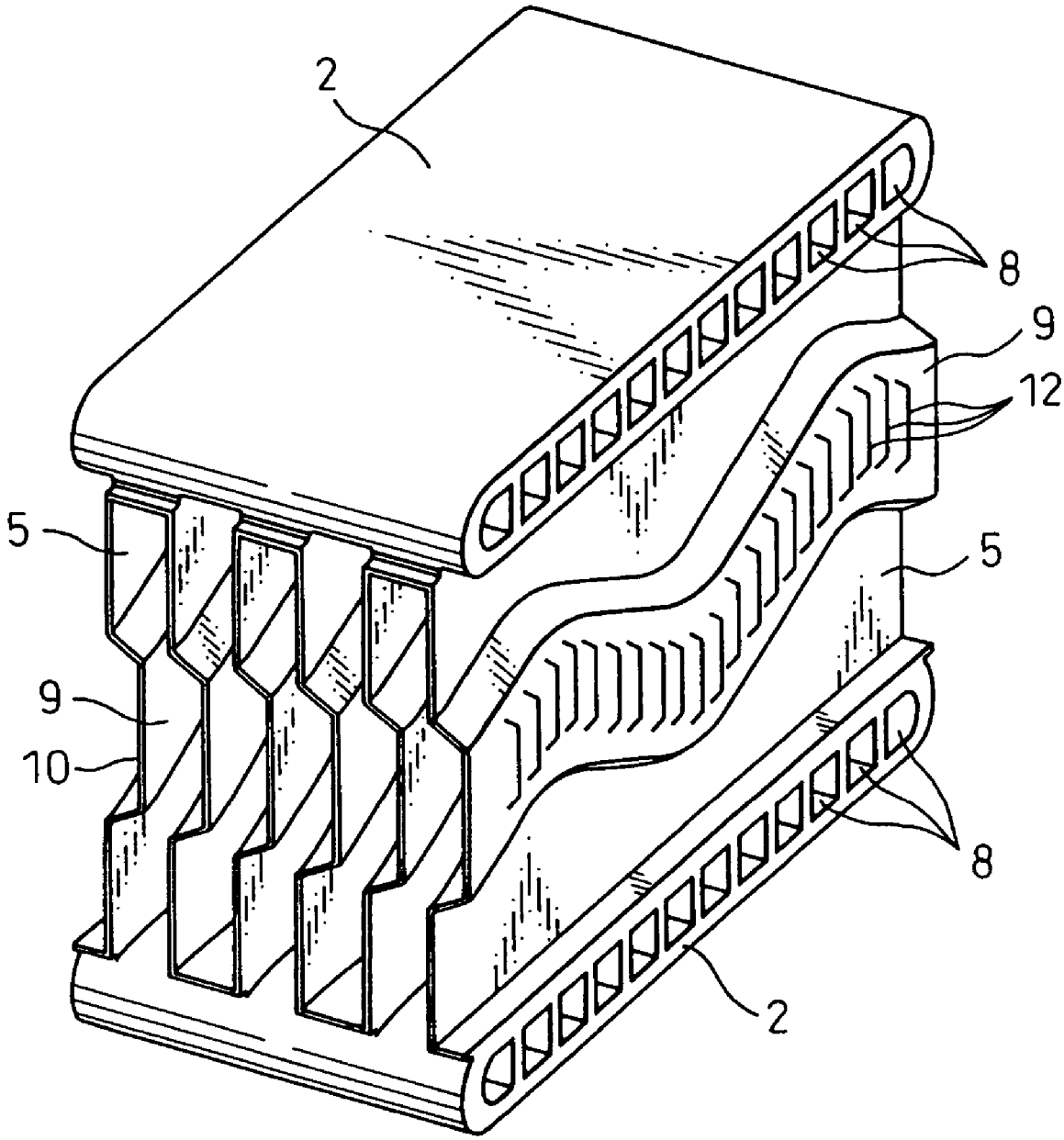
FIG. 8 is a perspective view illustrating specific dimensions of principal parts of a condenser of a third embodiment.

As a modification of the second embodiment, FIG. 8 shows principal parts of a condenser according to a third embodiment of the heat exchanger of the present invention. The overall configuration of the condenser of the third embodiment results in an appearance similar to the condenser of the first embodiment shown in FIG. 2 etc. While louvers 11 are formed by cutting and raising pieces of the top surfaces of the meandering projections 9 of the corrugated fins 5 in the second embodiment, the third embodiment is characterized by the formation of a large number of relief shapes 12 on the smooth top surfaces of the corrugated fins 5. In this case, it is also possible to change the heights of the projecting parts of the large number of relief shapes 12 so that the peaks of the projecting parts overall draw an envelope with a large waviness.

In the case of the third embodiment, pieces of the corrugated fins 5 are not cut and raised to form louvers 11 and thereby form openings at the bases of the large number of louvers 11 as in the second embodiment, but the turbulence is increased by the formation of the large number of relief shapes 12, so substantially the same actions and effects are exhibited as in the second embodiment.

Figure 9:
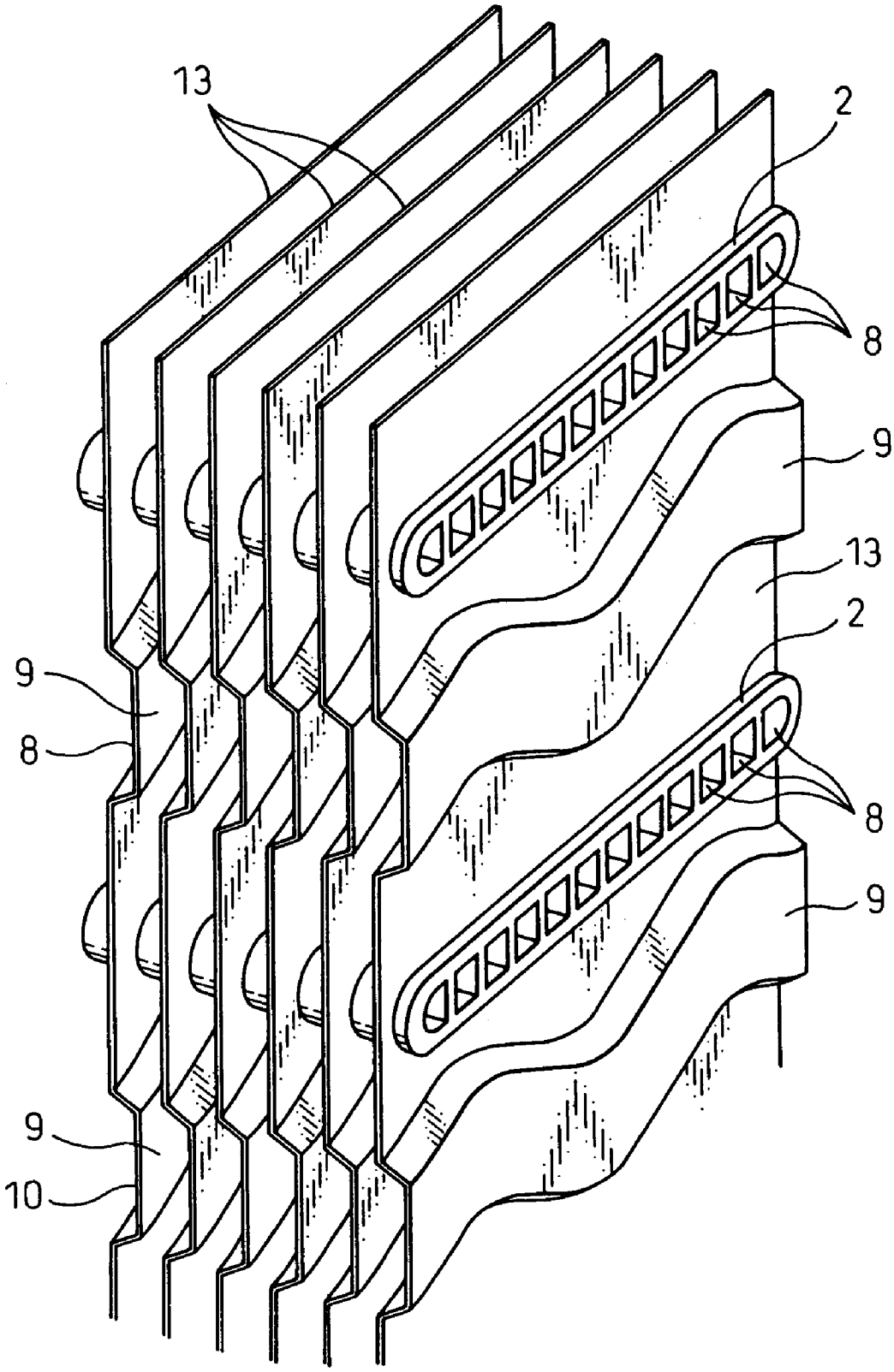
FIG. 9 is a perspective view illustrating specific dimensions of principal parts of a condenser of a fourth embodiment.

FIG. 9 shows only principal parts of a condenser according to a fourth embodiment of a heat exchanger of the present invention. In the condensers from the first embodiment to the third embodiment explained above, illustration was made of corrugated fins 5 sandwiched between two adjoining flat tubes 2. In the fourth embodiment, however, a condenser of the type where a large number of plate fins 13 of basically plate shapes are used, a plurality of flat tubes 2 are inserted through openings formed in advance in these plate fins 13, and the plate fins 13 and the flat tubes 2 are joined together by soldering is illustrated.

In the condenser of the fourth embodiment as well, the smooth surfaces of the plate fins 13 between two adjoining flat tubes 2 are formed with meandering projections 9 and grooves 10 of similar shapes as in the first embodiment. The shapes of the plate fins 13 differ somewhat from the corrugated fins 5, so the specific structure of the condenser of the fourth embodiment differs from that of the first embodiment in certain points, but the two embodiments are substantially equivalent when viewing just the point of heat exchange, so substantially the same actions and effects are exhibited.

Note that in the same way as there are the second embodiment shown in FIG. 7 and the third embodiment shown in FIG. 8 as modifications of the first embodiment shown in principal parts in FIG. 1, the fourth embodiment of FIG. 9, characterized by the use of the plate fins 13, may also be modified corresponding to the second embodiment or third embodiment, though not shown.

Figure 10:
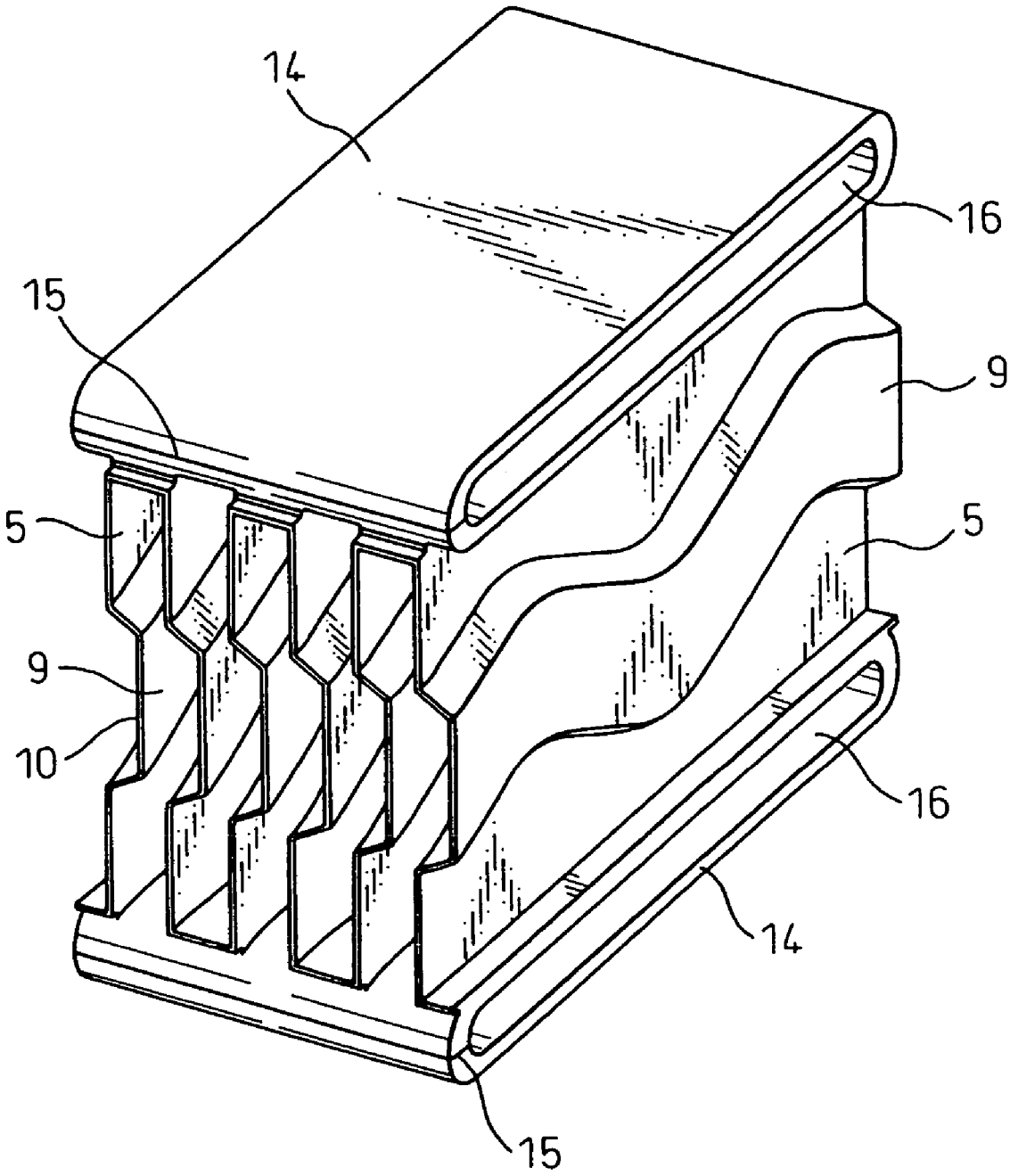
FIG. 10 is a perspective view illustrating specific dimensions of principal parts of a condenser of a fifth embodiment.

FIG. 10 shows only the principal parts of a condenser according to a fifth embodiment of a heat exchanger of the present invention. The condenser of the fifth embodiment uses corrugated fins 5 in the same way as the first embodiment. The overall configuration becomes that as shown in FIG. 1. It also matches it in the point of forming meandering projections 9 and grooves 10 at the smooth parts of the corrugated fins 5. The characterizing feature of the condenser of the fifth embodiment is that instead of using the flat tubes formed integrally with a large number of refrigerant passages 8 by extrusion as shown in the first embodiment, use is made of so-called "welded tubes" obtained by bending thin sheets of aluminum into flat tubular shapes and welding the joins together. The joins of the welded tubes 14 are shown by reference numerals 15.

To finely divide the insides of the welded tubes 14 to form something like the fine refrigerant passages 8, it is not impossible to form a large number of ridges serving as partitions in advance in the sheet materials of the welded tubes 14, but in this case illustration is made of bending uniform simple sheets to inexpensively fabricate the welded tubes 14, so the insides of the welded tubes 14 are formed with wide refrigerant passages 16 with no partitions. Therefore, the heat exchange efficiency is undeniably inferior to those of the previous embodiments, but corresponding to the characterizing features of the present invention, meandering projections 9 and grooves 10 are formed at the corrugated fins 5, so the improvement in the heat exchange efficiency is remarkable.

Note that while not shown, the condenser of the fifth embodiment shown in FIG. 10 also can be modified corresponding to the second embodiment shown in FIG. 7 or the third embodiment shown in FIG. 8 and can be modified to use the plate fins 13 as shown in FIG. 9 of course. Further, the illustrated embodiments were all those of condensers, but the present invention is not limited to a condenser and clearly can be worked as an evaporator, heater core, or other heat exchanger as well.

In the above embodiments, the tubes 2 and 14 through which a first fluid such as a refrigerant flows all have flat outer surfaces, but this does not mean that the tubes through which the first fluid flows have to be flat in order for the action or effects of the present invention to be obtained. Even if the sectional shapes of the outer surfaces of the tubes are circular, elliptical, polygonal, square, rectangular, star-shaped, or other shapes other than flat lozenge shapes (tablet shapes), while there is a difference in degree, generally the same actions and effects are obtained. The "difference in degree" means for example that since tubes of a circular sectional shape have a smaller surface area than lozenge-shaped tubes of a flat sectional shape having the same sectional area, the heat exchange efficiency at the surfaces of the tubes become somewhat lower. However, even with tubes of a circular sectional shape, if making the diameters smaller and arranging a plurality of them on the same plane, it is possible to obtain actions and effects similar to a single lozenge-shaped tube of a flat sectional shape.

Figure 11:
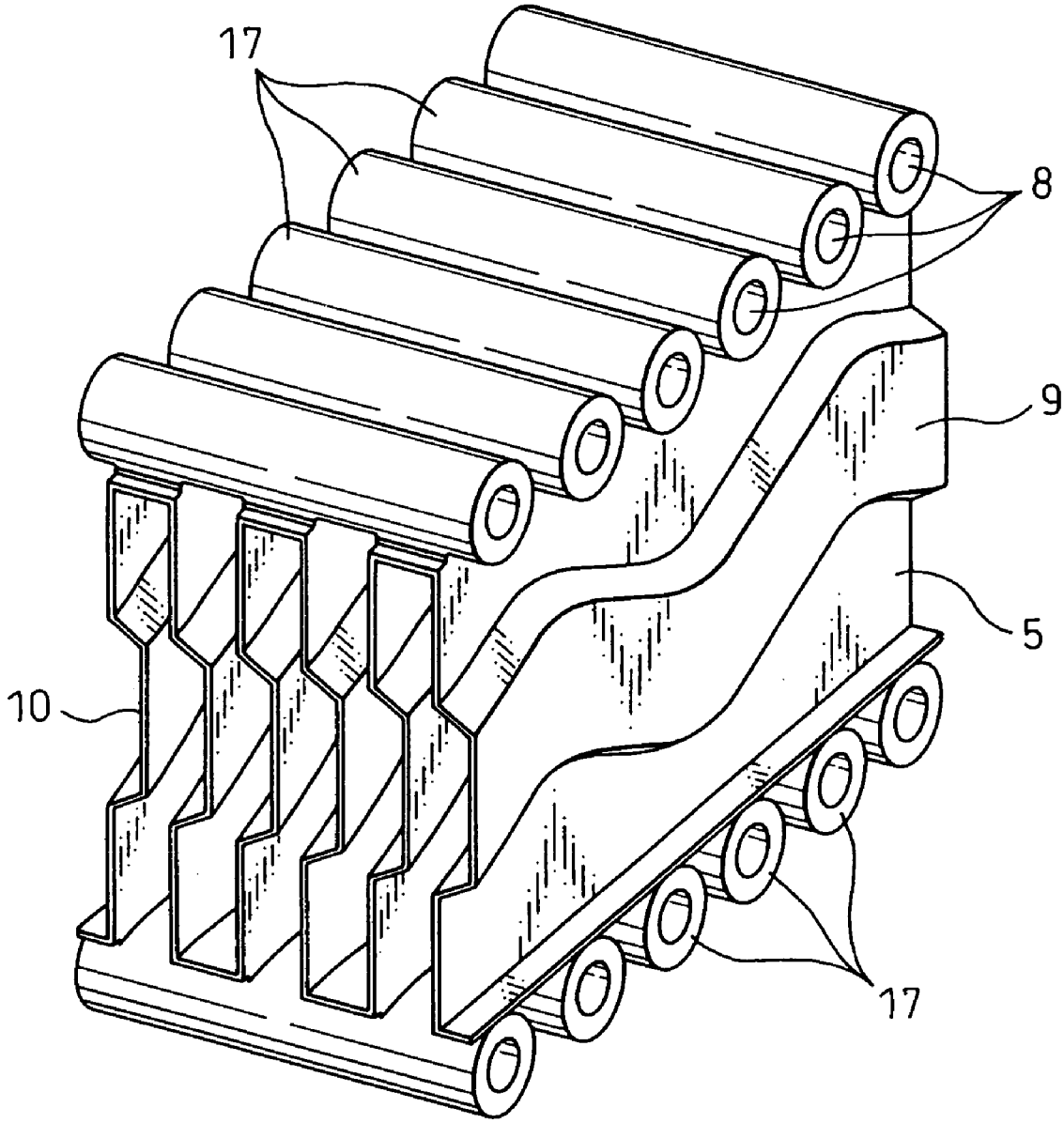
FIG. 11 is a perspective view illustrating specific dimensions of principal parts of a condenser of a sixth embodiment.

From this viewpoint, the principal parts of a condenser of a sixth embodiment of a heat exchanger of the present invention, corresponding to a modification of the first embodiment shown in FIG. 1, are shown in FIG. 11. In the sixth embodiment, instead of the flat tubes 2 of the first embodiment, a plurality of fine tubes 17 of circular sectional shapes obtained by extrusion from an aluminum material are used and arranged in parallel with each other on the same virtual plane so as to form an outer shape close to that of the flat tube 2 and a plurality of refrigerant passages 8. The individual circular tubes 17 are fused together so that the refrigerant passages 8 are independently communicated with the headers 3 and 4 as shown in FIG. 2, but it is also possible to arrange all of the tubes 17 in a planar form in advance and fuse together the adjoining ones before inserting and fusing the plurality of circular tubes 17 into the holes formed in the headers 3 and 4.

Corresponding to the characterizing feature of the present invention, the corrugated fins 5 formed with the meandering projections 9 (and meandering grooves 10) are similar to those of the first embodiment explained above. Further, the condenser of the sixth embodiment may have an overall appearance as shown for example in FIG. 2 or FIG. 4. Seen from the above configuration, the fact that the condenser of the sixth embodiment exhibits similar actions and effects as those of the first embodiment is believed to require no explanation. In the sixth embodiment, since the plurality of fine circular tubes 1 are aligned on the same plane and formed with relief shapes on their surfaces, the surface area becomes larger than that of flat tubes 2 of similar dimensions, so the heat exchange efficiency of the condenser of the sixth embodiment is rather increased over that of the first embodiment.

Figure 12:
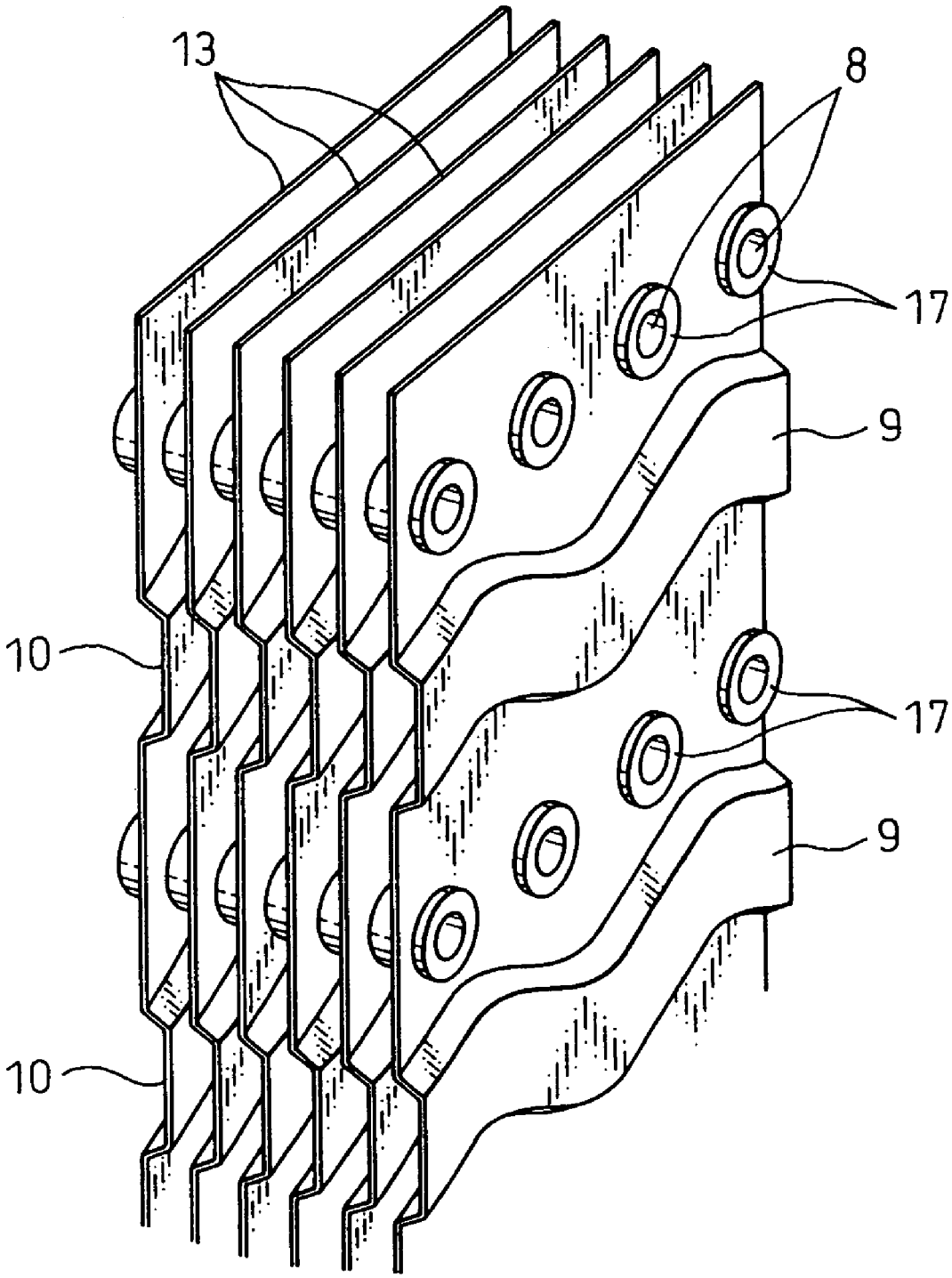
FIG. 12 is a perspective view illustrating specific dimensions of principal parts of a condenser of a seventh embodiment.

Based on similar thinking, FIG. 12 shows principal parts of a condenser according to a seventh embodiment of the present invention. The condenser of the seventh embodiment corresponds to a modification of the condenser of the fourth embodiment explained with reference to FIG. 9. It can be said that the flat tubes 2 passing through the plate-like fins 13 in the condenser of the fourth embodiment are replaced by a plurality of circular tubes 17. Therefore, the condenser of the seventh embodiment exhibits substantially the same actions and effects as the capacitor of the fourth embodiment.

Figure 13:
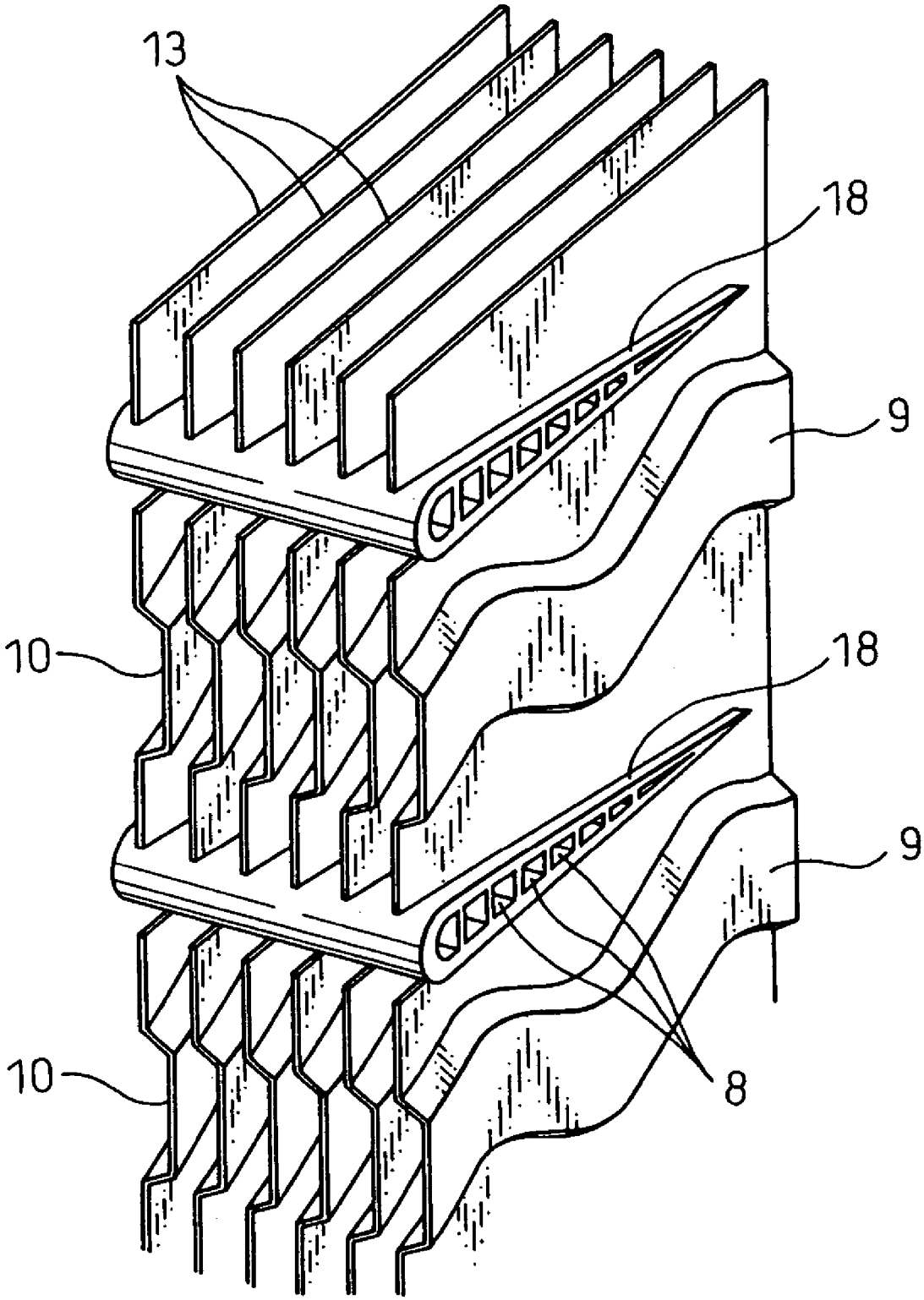
FIG. 13 is a perspective view illustrating specific dimensions of principal parts of a condenser of an eighth embodiment.

Finally, the principal parts of a condenser of an eighth embodiment of the present invention will be shown in FIG. 13. The condenser of the eighth embodiment also corresponds to a modification of the condenser of the fourth embodiment. That is, the flat tubes 2 in the condenser of the fourth embodiment are replaced by tubes 18 having outer surfaces of wedge-shaped sectional shapes in the eighth embodiment. A large number of refrigerant passages 8 are also formed inside the wedge-shaped tubes 18. The wedge-shaped tubes 18 can be easily produced by extrusion of aluminum etc.

As clear from this structure, the condenser of the eighth embodiment exhibits actions and effects similar to the condenser of the fourth embodiment. If forced to say it, the wedge-shaped tubes 18 in the eighth embodiment has a superior flow regulating action on the second fluid such as air after flowing through the passages between adjoining wedge-shaped tubes 18 compared even with the flat tubes 2.

Note that the condensers of the sixth to eighth embodiments may also of course be modified in manners corresponding to the second embodiment shown in FIG. 7 and the third embodiment shown in FIG. 8. Further, the sixth to eighth embodiments all also related to condensers, but their characterizing configurations are not limited to condensers and clearly can also be applied to heat exchangers in general such as evaporators and heater cores.

While the invention has been described with reference to specific embodiments chosen for purpose of illustration, it should be apparent that numerous modifications could be made thereto by those skilled in the art without departing from the basic concept and scope of the invention.

What is claimed is:

1. A heat exchanger comprising:

a plurality of tubes arranged in parallel with each other;

sheet-like fins attached to the plurality of tubes to bridge intervals between facing tubes, the sheet-like fins performing heat exchange between a first fluid flowing inside of the plurality of tubes and a second fluid flowing in contact with outer surfaces of the tubes and the fins; wherein a meandering projection is formed in each of said fins, the meandering projection extending over an entire width of the fin in a direction generally parallel with a flow direction of the second fluid to form a generally rectangular flow passage which extends through a respective interval between facing tubes in the direction generally parallel to the flow direction of the second fluid.

2. A heat exchanger as set forth in claim 1, wherein said projections meander centered about the flow direction of said second fluid so as to be directed toward said tubes.

3. A heat exchanger as set forth in claim 1, wherein top surfaces of the meandering projections are formed with louver-shaped pieces cut and raised, the louver-shaped pieces disturbing the flow of said second fluid.

4. A heat exchanger as set forth in claim 1, wherein top surfaces of the meandering projections are formed with relief shapes disturbing the flow of said second fluid.

5. A heat exchanger as forth in claim 4, wherein said relief shapes formed on the top surfaces of the meandering projections are arranged along wave shapes disposed in a longitudinal direction of said tubes about the flow direction of said second fluid.

6. A heat exchanger as set forth in claim 1, wherein said fins are corrugated fins bent into wave shapes between facing tubes.

7. A heat exchanger as set forth in claim 1, wherein said fins are plate fins of plate shapes connecting the plurality of said tubes.

8. A heat exchanger as set forth in claim 1, wherein said tubes have outer surfaces with flat sectional shapes.

9. A heat exchanger as set forth in claim 1, wherein said tubes have outer surfaces with wedge-shaped sectional shapes.

10. A heat exchanger as set forth in claim 8, wherein said tubes form a plurality of fluid passages.

11. A heat exchanger as set forth in claim 8, wherein said tubes form single fluid passages.

12. A heat exchanger as set forth in claim 9, wherein said tubes form a plurality of fluid passages.

13. A heat exchanger as set forth in claim 9, wherein said tubes form single fluid passages.

14. A heat exchanger as set forth in claim 1, wherein said tubes have outer surfaces with substantially circular sectional shapes.

15. A heat exchanger as set forth in claim 14, wherein a first plurality of said tubes are arranged on a first identical virtual plane and a second plurality of said tubes are arranged on a second virtual plane facing the first virtual plane.

16. A heat exchanger according to claim 1, wherein the flow passage comprises a single generally rectangular passage.

17. A heat exchanger according to claim 16, wherein the meandering projection includes a first wall directing the second fluid towards one of the facing tubes and a second wall directing the second fluid towards the other of the facing tubes.

18. A heat exchanger, comprising:

a plurality of flat tubes arranged in parallel with each other; and a plurality of corrugated fins disposed between adjacent pairs of the flat tubes so as to provide parallel arranged fin plates bridging the flat tubes, wherein each of the fin plates are formed with a first flat surface adjacent to and perpendicular to the flat tube, a second flat surface perpendicular to the flat tube, and a side surface between the first and second flat surfaces, the side surface facing a respective flat tube and continuously extending from an upstream edge to a downstream edge of the fin plate along a stream direction and smoothly meandering in wave-shape along the stream direction so that the side surface and the flat tube define a stream passage that repeats narrowing toward the flat tube and widening from the flat tube.

* * * * *